US006518003B1

(12) United States Patent
Haye et al.

(10) Patent No.: US 6,518,003 B1
(45) Date of Patent: Feb. 11, 2003

(54) THREE-PART CONCENTRATED PHOTOGRAPHIC COLOR DEVELOPING KIT AND METHODS OF USE

(75) Inventors: Shirleyanne E. Haye, Rochester, NY (US); Janet M. Huston, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/931,315

(22) Filed: Aug. 16, 2001

(51) Int. Cl.[7] ..... G03E 7/413
(52) U.S. Cl. ..... 430/466
(58) Field of Search ..... 430/466

(56) References Cited

U.S. PATENT DOCUMENTS

| | | | | |
|---|---|---|---|---|
| 4,876,174 | A | 10/1989 | Ishikawa et al. | 430/380 |
| 5,273,865 | A | 12/1993 | Loiacono et al. | 430/490 |
| 5,354,646 | A | 10/1994 | Kobayashi et al. | 430/372 |
| 5,660,974 | A | 8/1997 | Marrese et al. | 430/490 |
| 6,010,835 | A | 1/2000 | Thomas et al. | 430/466 |
| 6,077,651 | A | 6/2000 | Darmon et al. | 430/466 |
| 6,136,518 | A | 10/2000 | Buongiorne et al. | 430/486 |
| 6,159,670 | A | 12/2000 | Buongiorne et al. | 430/491 |

FOREIGN PATENT DOCUMENTS

EP 0 204 372 A1 10/1986

OTHER PUBLICATIONS

"Developer Composition and Method of Development For Photographic Color Negative Films" by R.A. Arcus et al, U.S. patent application Ser. No. 09/706,474 filed Nov. 3, 2000.

"Calcium Ion Stable Photographic Color Developing Composition and Method of Use" by S.E. Haye et al, U.S. patent application Ser. No. 09/438,121 filed Nov. 10, 1999, now U.S. Pat. No. 6,416,940.

*Primary Examiner*—Hoa Van Le
(74) *Attorney, Agent, or Firm*—J. Lanny Tucker

(57) ABSTRACT

A three-part color developing kit includes (I) a first concentrated aqueous solution having a pH of from about 11 to about 13.5 and comprising at least 0.25 mol/l of sulfite ions, at least $2.5\times10^{-5}$ mol/l of iodide ions, at least 0.05 mol/l of bromide ions, and at least 0.5 mol/l of a buffer having a pKa of from about 11 to about 13.5, (II) a second concentrated aqueous solution having a pH of from about 3 to about 6 and comprising at least 1 g/l of a vinyl pyrrolidone polymer, and at least 0.05 mol/l of an organic antioxidant, and a third concentrated aqueous solution having a pH of from about 1 to about 3 and comprising at least 0.05 mol/l of a color developing agent, and at least 0.005 mol/l of sulfite ions.

9 Claims, No Drawings

THREE-PART CONCENTRATED PHOTOGRAPHIC COLOR DEVELOPING KIT AND METHODS OF USE

FIELD OF THE INVENTION

The present invention relates to a three-part photographic color developing kit having three separate concentrated solutions that can be mixed together prior to or during use to form a homogeneous working strength color developing composition. This invention also relates to a method of using these three solutions to provide color photographic images. This invention is useful in the field of photography to provide color photographic images.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al.) describes conventional color developing compositions that have been a commercial success in the photographic industry. Other known color developing compositions are described in U.S. Pat. No. 4,876,174 (Ishikawa et al.), U.S. Pat. No. 5,354,646 (Kobayashi et al.), and U.S. Pat. No. 5,660,974 (Marrese et al.).

It is common practice to add a "replenishing" solution to the color developing composition in the processing machine in order to replace photochemicals that are depleted during reaction or carried away by the processed materials. Such replenishment insures uniform development and maximum stability of the color developing agent.

Color developing compositions are commonly supplied in three or more "parts" (or solutions) that are mixed immediately before use. Multiple parts are often required in order to separate and preserve the chemical activity and solubility of components that may otherwise deteriorate or react with each other when they are stored together for long periods of time under alkaline conditions. For example, one part might include a color developing agent. Another part might contain agents to preserve the alkalinity of the mixed color developing composition. Still another part may include an optical brightener. Upon combination of all parts and additional water, a color developing composition can usually be obtained for use in the photographic processing machine.

It is generally known that the concentrations of various photochemicals and pH (typically alkaline) used in a photographic processing bath must lie within certain narrow limits in order to provide optimal performance. A relatively small change in any of the component concentrations or pH can diminish desired photochemical activity, storage stability, solution homogeneity, or any combination of these. Thus, each "part" or solution used to make a working strength solution must be formulated to provide a desired balance of all desired properties.

While multi-part color developing compositions are widely used in the photoprocessing industry (including in what are known as "minilabs"), they are sometimes supplied in containers that are not completely emptied during use. The residual solutions must therefore be discarded into the environment. In some countries, any of these solutions having extremely low or high pH are considered hazardous wastes and require more costly and tedious disposal procedures.

To the unskilled person in the art, a simple solution to the problems would be to adjust pH so the solutions are no longer considered hazardous or corrosive. However, as pointed out above, this is not a simple matter and requires expert and complicated balancing of various components and pH to maintain stability and photochemical activity. As the number of "parts" and components in each increase, the number of possible modifications increases correspondingly, making it even harder to find the truly viable (that is commercial) options that will solve all of the problems simultaneously.

U.S. Pat. No. 6,136,518 (Buongiome et al.) describes two- and three-part color developing kits that solve the problems noted above. These kits are designed to be safely handled and disposed of because they are less hazardous than conventional solutions. The resulting color developing composition can be readily prepared by mixing the multiple solutions in a safe manner. In addition, the various "parts" are less corrosive to low-carbon steels they may contact during use.

Formulating various solutions of the kit in a certain manner, especially to provide concentrates, is critical in order to prevent the formation of precipitates either in those solutions or in the eventual color developing composition formed when all solutions are mixed.

There continues to be a need for concentrated three-part color developing compositions that can be used in various processing equipment and methods without concern for precipitation and loss in sensitometric properties.

SUMMARY OF THE INVENTION

This invention provides an advance in the art with a three-part color developing kit comprising:

(I) a first concentrated aqueous solution having a pH of from about 11 to about 13.5 and comprising:
- (a) at least 0.25 mol/l of sulfite ions,
- (b) at least $2.5\times10^{-5}$ mol/l of iodide ions,
- (c) at least 0.05 mol/l of bromide ions, and
- (d) at least 0.5 mol/l of a buffer having a pKa of from about 11 to about 13.5, (II) a second concentrated aqueous solution having a pH of from about 3 to about 6 and comprising:
- (a) at least 1 g/l of a vinyl pyrrolidone polymer, and
- (b) at least 0.05 mol/l of an organic antioxidant, and (III) a third concentrated aqueous solution having a pH of from about 1 to about 3 and comprising:
- (a) at least 0.05 mol/l of a color developing agent, and
- (b) at least 0.005 mol/l of sulfite ions.

This invention also provides a method of making a working strength color developing composition from the three concentrated aqueous solutions noted above comprising:

(A) combining the first, second, and third concentrated aqueous solutions noted above in such a manner that the volume ratio of the first concentrated aqueous solution to the second concentrated aqueous solution is from about 1:1 to about 1.5:1, the volume ratio of the first concentrated aqueous solution to the third concentrated aqueous solution is from about 1:1 to about 1.5:1, and the volume ratio of the second concentrated aqueous solution to the third concentrated aqueous solution is from about 1:1 to about 1.5:1, and, B) simultaneously or subsequently, diluting the first, second, and third concentrated aqueous solutions with water in such a manner as to dilute the first concentrated aqueous solution at least 8 times, the second concentrated aqueous solution at least 10 times, and the third concentrated aqueous solution at least 10 times.

Further, this invention includes a method for forming a color image comprising contacting an imagewise exposed color photographic silver halide material with the working strength color developing composition noted above.

In preferred embodiments, the color developed color photographic silver halide material can be desilvered using one or more desilvering processing compositions without removing the material from the working strength color developing composition.

The three-part color developing kit of this invention can also be provided as part of a larger photographic processing chemical kit that includes one or more other photographic processing single-part or multi-part photochemical processing compositions. Such photochemical processing compositions can include, but are not limited to, a photographic bleaching composition, a photographic bleach/fixing composition, a photographic fixing composition, and a photographic stabilizing or final rinsing composition.

The color developing kit of this invention has a number of advantages. In particular, the various concentrated aqueous solutions (or "parts") can be safely handled and disposed of. The resulting working strength color developing composition can be readily prepared by mixing the multiple solutions in a safe manner prior to or during use.

In addition, with the various concentrated aqueous solutions formulated in a particular manner with specific chemical components, they have desired stability to aerial oxidation and long term keeping properties. Because the solutions are concentrates, they can be provided in smaller packaged volumes for ease of transport, handling, and use, thereby reducing transportation and storage costs because of smaller volumes.

DETAILED DESCRIPTION OF THE INVENTION

The present invention provides a three-part color developing kit that can be used to provide color images in imagewise exposed color photographic silver halide elements. In this application, the terms "part" and "three-part" are well understood in the photographic industry to refer to a single "solution" or "three solutions", respectively. Generally, three-part kits require three individual solutions to be mixed in a suitable fashion to provide the desired working strength photoprocessing composition. Mixing of the concentrated solutions can occur prior to or during use in the processing apparatus.

The first concentrated aqueous solution contains sulfite ions, iodide ions, bromide ions, and a suitable buffer in water to maintain desired pH of from about 11 to about 13.5 (preferably from about 12 to about 13.5) as the essential components.

Sulfite ions are generally present in an amount of at least 0.25 mol/l (preferably at least 0.5 mol/l) and can be provided from any convenient salt form, including but not limited to, sodium sulfite, potassium sulfite, sodium bisulfite, potassium metabisulfite, and other sources readily apparent to one skilled in the art. The upper limit of sulfite ions is whatever would be practical and economical as readily determinable by one skilled in the art.

Iodide ions are present generally in an amount of at least $2.5\times10^{-5}$ mol/l and preferably of at least $7.5\times10^{-5}$ mol/l in any convenient salt form (such as sodium iodide or potassium iodide). The upper limit for iodide ions would be whatever is practical and economical as readily determinable by one skilled in the art.

Bromide ions are generally present in an amount of at least 0.05 mol/l and preferably of at least 0.1 mol/l in any convenient salt form (such as sodium bromide or potassium bromide). The upper limit for bromide ions is whatever is practical and economical as readily determinable by one skilled in the art.

Useful buffers for the first concentrated aqueous solution include those having a pKa of from about 11 to about 13.5. Such buffers include but are not limited to carbonates, glycine salts, triethanolamine, diethanolamine, phosphates, and hydroxybenzoates. Alkali metal carbonates (such as sodium carbonate, sodium bicarbonate and potassium carbonate) are preferred. The necessary amount of buffer will vary with the specific compound but is generally at least 0.5 mol/l and preferably at least 1 mol/l. The upper limit can be whatever is practical and necessary to maintain the pH as readily determinable by one skilled in the art.

The second concentrated aqueous solution provided by the present invention has a pH of from about 3 to about 6 (preferably from about 4 to about 6). This solution also includes a vinyl pyrrolidone polymer (including homopolymers and copolymers) in an amount of at least 1 g/l and preferably of at least 2 g/l as one essential component. The upper limit of polymer is whatever is practical and economical as readily determinable by one skilled in the art. Vinyl pyrrolidone polymers can be obtained from a number of commercial sources.

In order to protect color developing agents from oxidation during use, one or more organic antioxidants are included in the second concentrated solution as a second essential component. Useful organic antioxidants include, but are not limited to, hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Mixtures of compounds from the same or different classes of antioxidants can also be used if desired. Hydroxylamine in salt form (for example as a sulfate) is most preferred.

Useful hydroxylamine derivatives are described for example, in U.S. Pat. No. 4,892,804 (Vincent et al.), U.S. Pat. No. 4,876,174 (Ishikawa et al.), U.S. Pat. No. 5,354,646 (Kobayashi et al.), U.S. Pat. No. 5,660,974 (Marrese et al.), and U.S. Pat. No. 5,646,327 (Burns et al.). Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents. One useful hydroxylamine derivative is N,N-diethylhydroxylamine.

In other embodiments, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al.). Specific di-substituted hydroxylamine antioxidants include, but are not limited to, N,N-bis(2,3-dihydroxypropyl) hydroxylamine, N,N-bis(2-methyl-2,3-dihydroxypropyl)-hydroxylamine, and N,N-bis(1-hydroxymethyl-2-hydroxy-3-phenylpropyl)-hydroxylamine.

The one or more organic antioxidants are present in the second concentrated aqueous solution in an amount of at least 0.05 mol/l and preferably at least 0.075 mol/l. The general upper limit is whatever is practical and economical as determinable by one skilled in the art.

The third concentrated aqueous solution includes sulfite ions and one or more color developing agents as the essential components.

Color developing agents are compounds well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure,* publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to herein as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art. The most preferred color developing agent is KODAK Color Developing Agent CD-4.

The one or more color developing agents are present in an amount of at least 0.05 mol/l and preferably of at least 0.1 mol/l. The upper limit of the color developing agent(s) is whatever is practical and economical as readily determinable by one skilled in the art.

Sulfite ions are also present in the third concentrated aqueous solution and can be provided as one or more salts such as sodium sulfite, sodium bisulfite, potassium sulfite, sodium bisulfite, and potassium metabisulfite. Potassium metabisulfite is preferred. The amount of sulfite ions is at least 0.005 mol/l and preferably at least 0.01 mol/l. The upper limit is whatever is practical and economical as readily determined by one skilled in the art.

The third concentrated aqueous solution generally has a pH of from about 1 to about 3, and preferably from about 2 to about 3, and can be adjusted using a suitable acid.

One or more of the concentrated aqueous solutions described above can include one or more metal ion (such as calcium ion) sequestering or chelating agents such as various polycarboxylic acids and polyphosphonic acids as described for example in U.S. Pat. No. 4,546,068 (Kuse), U.S. Pat. No. 4,596,765 (Kurematsu et al.), U.S. Pat. No. 4,892,804 (Vincent et al.), U.S. Pat. No. 4,975,357 (Buongiome et al.), U.S. Pat. No. 5,034,308 (Abe et al.), and *Research Disclosure,* Item 20405 (April, 1981), Item 18837 (December, 1979), Item 18826 (December, 1979), and Item 13410 (December, 1975).

Phosphonic acid metal ion sequestering agents are well known in the art, and are described for example in U.S. Pat. No. 4,596,765 (Kurematsu et al) and *Research Disclosure* publications 13410 (June, 1975), 18837 (December, 1979) and 20405 (April, 1981). Useful sequestering agents are readily available from a number of commercial sources. Particularly useful phosphonic acids are the diphosphonic acids (and salts thereof) and polyaminopolyphosphonic acids (and salts thereof) described below. It is preferable to use one or more compounds of these classes in combination. Useful diphosphonic acids include hydroxyalkylidene diphosphonic acids, aminodiphosphonic acids, amino-N,N-dimethylenephosphonic acids, and N-acyl aminodiphosphonic acids.

One useful class of diphosphonic acids includes hydroxyalkylidene diphosphonic acids (or salts thereof). Mixtures of such compounds can be used if desired. Useful salts include the ammonium and alkali metal ion salts. Preferred hydroxyalkylidene diphosphonic acids (or salts thereof) can be represented by the following Structure I:

I

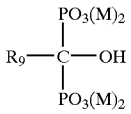

wherein $R_9$ is a substituted or unsubstituted alkyl group having 1 to 5 carbon atoms (methyl, methoxymethyl, ethyl, isopropyl, n-butyl, t-butyl and n-pentyl)and M is hydrogen or a monovalent cation (such as ammonium or alkali metal ions). Preferably, $R_9$ is methyl or ethyl, and most preferably, it is ethyl.

Representative sequestering agents of this class include, but are not limited to, 1-hydroxyethylidene-1,1-diphosphonic acid, 1-hydroxy-n-propylidene-1,1-diphosphonic acid, 1-hydroxy-2,2-dimethylpropylidene-1,1-diphosphonic acid and others that would be readily apparent to one skilled in the art (and alkali metal and ammonium salts thereof). The first compound is most preferred and is available as DEQUEST™ 2010. Its tetrasodium salt is available as DEQUEST™ 2016D. Both materials are available from Solutia Co.

Another useful disphosphonic acid is morpholinomethane-diphosphonic acid or a salt thereof that is available as BUDEX™ 5103 from Budenheim (German). This and similar cyclicaminodiphosphonic acids (and salts) are described in U.S. Pat. No. 4,873,180 (Marchesano et al.).

A mixture of one or more diphosphonic acids can be used in the concentrated solutions if desired, in any desirable proportions.

Another polyphosphonic acid is a polyaminopolyphosphonic acid (or salt thereof) that has at least five phosphonic acid (or salt) groups. A mixture of such compounds can be used if desired. Suitable salts include ammonium and alkali metal (for example, sodium and potassium) ion salts. Such materials can be used as the only phosphonic acid in the second solution, but preferably they are used in combination with one or more diphosphonic acids are described above.

Preferred compounds of this nature can be represented by the following Structure II:

II

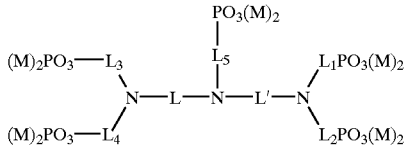

wherein L, L', $L_1$, $L_2$, $L_3$, $L_4$ and $L_5$ are independently substituted or unsubstituted divalent aliphatic linking groups, each independently having 1 to 4 carbon, oxygen, sulfur or nitrogen atoms in the linking group chain. Preferably, these substituted or unsubstituted divalent linking groups have 1 to 4 carbon atoms in the linking group chain (such as substituted or unsubstituted branched or linear alkylene groups). More preferably, the divalent linking groups are independently substituted or unsubstituted methylene or ethylene. Most preferably, L and L' are each substituted or unsubstituted ethylene (preferably unsubstituted), and each of the other linking groups is an unsubstituted methylene group. M is hydrogen or a monovalent cation (such as ammonium ion or an alkali metal salt).

A particularly useful sequestering agent of this type is diethylenetriaminepentamethylenephosphonic acid or an alkali metal salt thereof (available as DEQUEST™ 2066 from Solutia Co.).

It is also possible to include other metal ion sequestering agents (for example, for iron, copper or manganese ion sequestration) in one or more of the concentrated aqueous solutions in the color developing kit.

The one or more concentrated aqueous solutions of the kit can also include one or more of a variety of other addenda that are commonly used in photographic color developing compositions, including auxiliary co-developing agents (such as phenidone type compounds particularly for black and white developing compositions), antifoggants, development accelerators, wetting agents, fragrances, stain reducing agents, surfactants, defoaming agents, optical brighteners, and water-soluble or water-dispersible color dye forming couplers, as would be readily understood by one skilled in the art [see for example, the *Research Disclosure* publications noted above]. The amounts of such additives would be well known to a skilled artisan in view of their usual concentrations in working strength compositions.

In preferred embodiments of this invention, a three-part color developing kit comprises the following three concentrated aqueous solutions:

(I) a first concentrated aqueous solution that has a pH of from about 12 to about 13.5 and comprises:
  (a) at least 0.5 mol/l of sulfite ions,
  (b) at least $7.5\times10^{-5}$ mol/l of iodide ions,
  (c) at least 0.1 mol/l of bromide ions, and
  (c) at least 1 mol/l of a carbonate buffer, (II) a second concentrated aqueous solution having a pH of from about 4 to about 6 and comprising:
  (a) at least 2 g/l of poly(vinyl pyrrolidone), and
  (b) at least 0.075 mol/l of a hydroxylamine antioxidant, and (III) a third concentrated aqueous solution having a pH of from about 2 to about 3 and comprising:
  (a) at least 0.1 mol/l of 4-(N-ethyl-N-β-hydroxyethylamino)-2-methylaniline sulfate (KODAK Color Developing Agent CD-4), and
  (b) at least 0.01 mol/l of sulfite ions.

The multiple concentrated aqueous solutions of the color developing kit are mixed in a suitable fashion to form a working strength color developing composition either during or prior to its use. Thus, the concentrated aqueous solutions can be appropriately metered into a vessel to form the working strength composition, or they can be metered into the processing tank at a suitable rate during use (that is during photoprocessing).

In either case, the first and second concentrated solutions are mixed at a volume ratio of from about 1:1 to about 1.5:1. The first and third aqueous concentrated solutions are mixed at a volume ratio of from about 1:1 to about 1.5:1, and the second and third concentrated aqueous solutions are mixed at a volume ratio of from about 1:1 to about 1.5:1.

At the same time as the mixing, or subsequently thereto, the first, second, and third concentrated aqueous solutions are diluted with water at least 8, 10, and 10 times, respectively. Thus, water can be added to the mixed solutions, or water can be metered separately into the mixture when the concentrated aqueous solutions are mixed. Alternatively, water can be metered as a fourth stream into a processing vessel when the three concentrated aqueous solutions are separately metered into the vessel. The final pH of the working strength composition is generally from about 10.1 to about 10.8.

The working strength color developing compositions obtained from the kit of this invention have utility to provide color development in an imagewise exposed color photographic silver halide element comprising a support and one or more color silver halide emulsion layers containing an imagewise distribution of developable silver halide emulsion grains. A wide variety of types of photographic elements (both color negative and color reversal films and papers, and color motion picture films and prints) containing various types of emulsions can be processed using the present invention, the types of elements being well known in the art (see *Research Disclosure* publication 38957 noted above).

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

If the present invention is used to process color photographic papers, those papers generally include high chloride (greater than 70 mole % chloride and preferably greater than 90 mole % chloride, based on total silver) emulsions. Such color photographic papers can have any useful amount of silver coated in the one or more emulsions layers, and in some embodiments, low silver (that is, less than about 0.8 g silver/$m^2$) elements can be processed with the present invention.

Representative commercial color papers that can be processed include, but are not limited to, KODAK EKTACOLOR EDGE V, VII and VIII Color Papers (Eastman Kodak Company), KODAK ROYAL VII Color Papers (Eastman Kodak Company), KODAK PORTRA III, IIIM Color Papers (Eastman Kodak Company), KODAK SUPRA III and IIIM Color Papers (Eastman Kodak Company), KODAK ULTRA III Color Papers (Eastman Kodak Company), FUJI SUPER Color Papers (Fuji Photo Co., FA5, FA7 and FA9), FUJI CRYSTAL ARCHIVE and Type C Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic elements can be readily determined by one skilled in the art.

KODAK DURATRANS, KODAK DURACLEAR, KODAK EKTAMAX and KODAK DURAFLEX photographic materials and KODAK Digital Paper Type 2976 can also be processed using the present invention.

Preferably the present invention is used to process color negative films that generally have a transparent polymeric film support and various emulsion and interlayers thereon to provide three color records. Such elements are also very well known in the art as described for example in U.S. Pat. No. 6,013,424 (Schmittou et al.) and *Research Disclosure* noted above and include those having a magnetic recording layer or strip on the support opposite the silver halide emulsion layers.

Representative color negative films that can be processed using the present invention include, but are not limited to, KODAK ROYAL GOLD Color Films, KODAK MAX Color Films, KODAK ADVANTiX Color Films, KODAK VERICOLOR III Color Films, KONICA VX400 Color Film, KONICA Super SR400 Color Film, FUJI SUPER Color Films, LUCKY Color Films, and other commercial products currently on the market. Color negative films used in "one-time-use" cameras can also be processed using the present invention.

Color development of an imagewise exposed photographic silver halide element is carried out by contacting the element with a working strength color developing composition prepared according to this invention under suitable time and temperature conditions and in suitable processing equipment, to produce the desired developed color images. Additional processing steps can then be carried out using conventional procedures, including but not limited to, one or more development stop, desilvering steps (such as bleaching, fixing, or bleach/fixing), washing (or rinsing), stabilizing and drying steps, in any particular desired order as would be known in the art. Useful processing steps, conditions and materials useful therein are well known for the various processing protocols including the conventional Process C-41 processing of color negative films, Process RA-4 for processing color papers and Process E-6 for processing color reversal films (see for example, *Research Disclosure* publication 38957 noted above).

More details of the element structure and components, and suitable methods of processing various types of elements are described in *Research Disclosure* publication 38957 (noted above). Included within such teachings is the use of various classes of cyan, yellow and magenta color couplers that can be used with the present invention (including pyrazolone and pyrazolotriazole type magenta dye forming couplers.

The working strength color developing composition can also be used in what are known as redox amplification processes, as described for example, in U.S. Pat. No. 5,723,268 (Fyson) and U.S. Pat. No. 5,702,873 (Twist).

In a preferred embodiment, the working strength color developing composition prepared according to this invention is brought into contact with the imagewise exposed color photographic silver halide material in any suitable fashion in a processing tank. Alternatively, the processing composition can be sprayed onto the material using suitable application devices. Without removing the material from the color developing composition, it is then subjected to desilvering, that is removal of silver. This can be done with one or more steps, including a bleaching step following by a fixing step, a fixing step followed by a bleaching step and/or a fixing step, a single bleach/fixing step, or any combination thereof. It is essential in this embodiment that the desilvering step(s) be carried out without removing the color photographic silver halide material from the working strength color developing composition. In other words, the desilvering composition(s) are added to the color developing composition after a sufficient time for color development, or sprayed onto the material without removing the color developing composition.

Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure* publication 38957 noted above, U.S. Pat. No. 5,582,958 (Buchanan et al) and U.S. Pat. No. 5,753,423 (Buongiome et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al.).

Useful fixing agents are also well known in the art and include various thiosulfates and thiocyanates or mixtures thereof as described for example in U.S. Pat. No. 6,013,424 (Schmittou et al.).

The processing time and temperature used for each processing step of the present invention can be those conventionally used in the art. For example, color development and desilvering can be generally carried out independently at temperatures of from about 20 to about 60° C. The overall color development time can be up to 40 minutes, and preferably from about 75 to about 450 seconds. More preferably, the color development time is from about 30 to about 90 seconds when processing color negative films. Even shorter color development times may be used for processing color photographic papers.

Desilvering can be carried out for from about 30 to about 480 seconds using one or more bleaching, fixing, or bleach/fixing steps. Preferably, a fixing step is carried out for from about 20 to about 240 seconds followed by a bleaching step for from about 20 to about 240 seconds.

Processing according to the present invention can be carried out using any suitable processing machine including those having deep tanks for holding processing solutions. Alternatively, it can be carried out using what is known in the art as "low volume thin tank" processing systems, or LVTT, which have either a rack and tank or automatic tray design. These processors are sometimes known as "minilab" processing machines. Such processing methods and equipment are described, for example, in U.S. Pat. No. 5,436,118 (Carli et al.) and publications noted therein. Some useful minilab processing machines are commercially available as Noritsu 2211SM Printer/Paper Processor, Noritsu 2102SM Printer/Paper Processor and Noritsu 2301SM Printer/Paper Processor.

The color developing kit of this invention can be included in larger photoprocessing kits that include one or more other photographic processing compositions (dry or liquid) including, but not limited to, a photographic bleaching composition, a photographic bleach/fixing composition, a photographic fixing composition, and a photographic dye stabilizing or rinsing composition. Such additional compositions can be formulated in concentrated or working strength solutions, or provided in dry form (for example, as a powder or tablet). Other processing compositions that can be included in such kits for either black and white or color photographic processing are reversal compositions, conditioning compositions, prebleach compositions, acidic stop compositions, and others readily apparent to one skilled in the photographic art. The processing kits can also include various processing equipment, metering devices, processing instructions, silver recovery devices and other conventional materials as would be readily apparent to one skilled in the art.

The various concentrated aqueous solutions of the color developing kit of this invention (and any other desired photoprocessing compositions) can be provided in various packaged forms and/or containers. They can be provided in bottles, drums, flexible containers (for example, what are known as "cubitainers" or "bag-in-a-box"), vials, packets or any other suitable container. The volumes for each aqueous solution can be the same or different. The containers can also be packaged together in a suitable manner for ease of shipping, use and disposal.

In one embodiment, the first, second and third concentrated aqueous solutions described above for the kit of this invention are provided in individual flexible (or collapsible) containers having some type of dispensing means (or conduit). Such embodiments are described in detail in U.S. Pat. No. 5,577,614 (Palmeroni, Jr. et al.), incorporated herein by reference. In such embodiments, the flexible containers (or various sizes) are packaged together in a package that is designed for both shipping and solution dispensing, such as in a minilab processing machine. For example, the dispensing conduits of the flexible containers are designed for mating with valves and other connectors in the minilab processing machines.

The following examples are provided to illustrate the practice of this invention and not to limit it in any way. Unless otherwise indicated, percentages are by weight.

EXAMPLE 1

Three-Part Color Developing Kit

A most preferred color developing kit of this invention was formulated with three concentrated solutions in the following manner:

A "first" concentrated aqueous solution was prepared by mixing, potassium sulfite (anhydrous) (45% solution, 0.83 mol/l), potassium iodide (0.13 mol/l), sodium bromide (0.224 mol/l), diethylenetriaminepentamethylenephosphonic acid, sodium salt (40% solution, 0.13 mol/l), and potassium carbonate buffer (47% solution, 4.9 mol/l). Water was added to provide 1 liter of concentrated solution. The solution pH was 12.4.

A "second" concentrated aqueous solution was prepared by mixing hydroxylamine sulfate antioxidant (0.18 mol/l) and poly(vinyl pyrrolidone) (30 g/l). Water was then added to 1 liter of solution. The solution of pH was adjusted to 5.5 using sulfuric acid.

A "third" concentrated aqueous solution was prepared by mixing sodium metabisulfite (0.018 mol/l) and KODAK CD-4 Color Developing Agent (0.51 mol/l) with water to 1 liter, and the solution pH was adjusted to 2.2 using sulfuric acid.

EXAMPLE 2

Color Developing Composition and Processing Method

The three-part color developing kit described in Example 1 was used to prepare a working strength color developing composition by mixing them together in the following amounts:

First concentrated solution: 125 ml,

Second concentrated solution: 100 ml,

Third concentrated solution: 100 ml.

The pH of the mixture was adjusted to 10.48 and water was added to 1 liter.

EXAMPLE 3

Photographic Processing

The working strength color developing composition of Example 2 was used for color development in processing imagewise exposed samples of commercially available KODAK ROYAL GOLD 400 Color Film and KODAK MAX ZOOM 800 Color Film in the following manner. The film samples were color developed in the working strength composition for 30 seconds at 45° C. They were then bleached using KODAK FLEXICOLOR Bleach III for 30 seconds at 45° C., followed by fixing using KODAK FLEXICOLOR Fixer for 30 seconds at 45° C. Lastly, the film samples were washed with KODAK FLEXICOLOR Final Rinse for 45 seconds and allowed to air dry at room temperature. All samples had the desired color image.

EXAMPLE 3

Color Development Using "Merged" Photoprocessing

The working strength color developing composition of Example 2 was also used to process imagewise exposed samples of KODAK ROYAL GOLD 400 and KODAK MAX ZOOM 800 Color Negative Films in a photoprocessing protocol in which the processing compositions were added to a vessel in sequence without removal of previous compositions. Thus, the color developing, fixing, and bleaching compositions were added at a volume ratio of 6:4:4 ml/linear foot for 60, 30, and 30 seconds, respectively. Fixing and bleaching were carried out using KODAK FLEXICOLOR Fixer and Bleach, respectively.

After bleaching was finished, the final solution was discarded and a KODAK FLEXICOLOR Final Rinse was added to the vessel. After 45 seconds, the film samples were removed from the vessel were allowed to air dry at room temperature. The desired color images were observed in the film samples.

The invention has been described in detail with particular reference to preferred embodiments thereof, but it will be understood that variations and modifications can be effected within the spirit and scope of the invention.

We claim:

1. A three-part color developing kit comprising:

(I) a first concentrated aqueous solution having a pH of from about 11 to about 13.5 and comprising:

(a) at least 0.25 mol/l of sulfite ions, (b) at least $2.5\times10^{-5}$ mol/l of iodide ions, (c) at least 0.05 mol/l of bromide ions, and (d) at least 0.5 mol/l of a buffer having a pKa of from about 11 to about 13.5, (II) a second concentrated aqueous solution having a pH of from about 3 to about 6 and comprising:
(a) at least 1 g/l of a vinyl pyrrolidone polymer, and
(b) at least 0.05 mol/l of an organic antioxidant, and (III) a third concentrated aqueous solution having a pH of from about 1 to about 3 and comprising:
(a) at least 0.05 mol/l of a color developing agent, and
(b) at least 0.005 mol/l of sulfite ions.

2. The color developing kit of claim 1 wherein said first concentrated aqueous solution has a pH of from about 12 to about 13.5, said second concentrated aqueous solution has a pH of from about 4 to about 6, and said third concentrated aqueous solution has a pH of from about 2 to about 3.

3. The color developing kit of claim 1 wherein said color developing agent is present in said third concentrated aqueous solution in an amount of at least 0.1 mol/l, said organic antioxidant is present in said second aqueous concentrated solution in an amount of at least 0.075 mol/l, said sulfite ions are present in said first concentrated aqueous solution in an amount of at least 0.5 mol/l, said iodide ions are present in said first concentrated aqueous solution in an amount of at least $7.5\times10^{-5}$ mol/l, said bromide ions are present in said first concentrated aqueous solution in an amount of at least 0.1 mol/l, and said sulfite ions are present in said third concentrated aqueous solution in an amount of at least 0.01 mol/l.

4. The color developing kit of claim 1 wherein said pyrrolidone polymer is present in said second concentrated aqueous solution in an amount of at least 2 g/l.

5. The color developing kit of claim 1 wherein said antioxidant is hydroxylamine or a hydroxylamine derivative.

6. The color developing kit of claim 1 wherein said buffer in said first concentrated aqueous solution is a carbonate buffer.

7. The color developing kit of claim 1 wherein one of said first, second, or third concentrated aqueous solutions contains a polycarboxylic acid or polyphosphonic acid metal ion sequestering agent.

8. A three-part color developing kit comprising:

(I) a first concentrated aqueous solution that has a pH of from about 12 to about 13.5 and comprises:
(a) at least 0.5 mol/l of sulfite ions,
(b) at least $7.5\times10^{-5}$ mol/l of iodide ions,
(c) at least 0.1 mol/l of bromide ions, and
(d) at least 1 mol/l of a carbonate buffer, (II) a second concentrated aqueous solution having a pH of from about 4 to about 6 and comprising:
(a) at least 2 g/l of poly(vinyl pyrrolidone), and
(b) at least 0.075 mol/l of a hydroxylamine antioxidant, and (III) a third concentrated aqueous solution having a pH of from about 2 to about 3 and comprising:
(a) at least 0.1 mol/l of 4-(N-ethyl-N-β-hydroxyethylamino)-2-methylaniline sulfate (KODAK Color Developing Agent CD-4), and
(b) at least 0.01 mol/l of sulfite ions.

9. A photographic processing chemical kit comprising:

a) the three-part color developing kit of claim 1, and b) one or more of the following compositions:
a photographic bleaching composition,
a photographic bleach/fixing composition,
a photographic fixing composition, and
a photographic stabilizing or final rinsing composition.

* * * * *